US007600509B2

(12) United States Patent
Gabrel

(10) Patent No.: US 7,600,509 B2
(45) Date of Patent: Oct. 13, 2009

(54) PAINTBALL GUN SYSTEM WITH SECURE QUICK-CONNECT PRESSURE COUPLING

(75) Inventor: Stanley Gabrel, Round Lake, IL (US)

(73) Assignee: Tippmann Sports, LLC, Fort Wayne, IN (US)

( * ) Notice: Subject to any disclaimer, the term of this patent is extended or adjusted under 35 U.S.C. 154(b) by 0 days.

(21) Appl. No.: 11/678,774

(22) Filed: Feb. 26, 2007

(65) Prior Publication Data

US 2007/0251515 A1 Nov. 1, 2007

Related U.S. Application Data

(60) Provisional application No. 60/776,542, filed on Feb. 25, 2006.

(51) Int. Cl.
*F41B 11/32* (2006.01)

(52) U.S. Cl. ..... 124/73

(58) Field of Classification Search ..... 124/63, 124/69, 73, 74; 137/625.25, 625.69; 251/149
See application file for complete search history.

(56) References Cited

U.S. PATENT DOCUMENTS 2,526,018 A * 10/1950 Foster et al. ..... 124/73
3,404,705 A * 10/1968 Zopf et al. ..... 137/625.25
3,570,809 A * 3/1971 Stuy ..... 251/149.9
3,589,673 A * 6/1971 Cruse ..... 251/149.1
4,181,143 A * 1/1980 Fallon ..... 137/322
4,576,199 A * 3/1986 Svensson et al. ..... 137/614.04
4,890,597 A * 1/1990 Ekstrom ..... 124/74
5,086,749 A * 2/1992 Ekstrom ..... 124/74
5,158,110 A * 10/1992 Jernberg ..... 137/614.19
5,363,834 A * 11/1994 Stuchlik ..... 124/76
5,660,160 A * 8/1997 Prescott, Jr. ..... 124/75
5,695,153 A * 12/1997 Britton et al. ..... 244/63
5,755,213 A * 5/1998 Gardner et al. ..... 124/73
5,957,119 A * 9/1999 Perry et al. ..... 124/73
6,202,636 B1 * 3/2001 O'Brien ..... 124/71
6,213,111 B1 * 4/2001 Alexander et al. ..... 124/71
6,543,475 B2 * 4/2003 Colby ..... 137/505.25
2003/0034021 A1 * 2/2003 Gabrel ..... 124/71
2006/0162713 A1 * 7/2006 Carpenter et al. ..... 124/73
2006/0249132 A1 * 11/2006 Gabrel ..... 124/70

* cited by examiner

*Primary Examiner*—Bret Hayes
(74) *Attorney, Agent, or Firm*—Barnes & Thornburg LLP

(57) ABSTRACT

A paintball gun system comprises a gun body and a propellant tank interconnected by a quick-change coupling. The quick-change coupling partially defines a fluid pathway between the tank and the gun body in that it is included in a sequence of components from the tank to a pneumatic circuit in the paintball gun body. The quick-change coupling includes a gun-side fitting and a tank-side fitting. The gun-side fitting is in communication with the gun body at one end and terminates in an opposite open-end configured for sealed engagement of the tank-side fitting. The tank-side fitting being is in communication with the tank and has an opposite open end for sealed engagement of the gun-side fitting. Each fitting has complementary interlocking contours.

22 Claims, 8 Drawing Sheets

PAINTBALL GUN SYSTEM WITH SECURE QUICK-CONNECT PRESSURE COUPLING

CROSS-REFERENCE TO RELATED PATENT APPLICATIONS

This application claims priority from U.S. Provisional Applications for Patent No. 60/776,542 filed on 25 Feb. 2006.

FIELD OF INVENTION

This invention relates to paintball marking guns, marking gun regulators and propellant tanks.

BACKGROUND OF THE INVENTION

Paintball marking guns are used in a variety of targeting and simulated battle games (e.g., capture the flag). These guns launch a ball of paint with a frangible shell that is designed to hold the ball shape until striking an object after firing. Upon striking the object, the ball is set to break open leaving a paint spot.

Paintball guns typically employ a firing system powered by compressed gas such as air. Compressed air is supplied from a canister which is mounted to or carried with the gun. The gun systems also include a gun body, a paintball hopper and one or more pressure regulators which receive gas from the tank at a relatively high pressure and deliver gas at a reduced, more consistent pressure to the gun body for propelling the paintball.

The pressure regulators are modular and typically include at least two major components interconnected with threaded portions. One well-accepted type of gun system design calls for a pressure regulator to be threaded directly into the supply canister (i.e., tank) at one end and threaded into a receptacle mounted to the gun grip at the other end.

Although modular paintball regulator designs are preferred for performance and maintenance, it is a concern that paintball regulator parts may be inadvertently separated when a paintball player attempts to remove the regulator-tank combination from the paintball gun. If such parts are disassembled before the canister is discharged, the ultimate separation can be violent and therefore unsafe.

Separate from the safety issues are concerns about delay and thread wear. Paintball players often prefer to use the same gun with different tank-regulator combinations in the same tournament or round of play. Likewise, players may wish to have a fresh charge of propellant without refilling by swapping in a new filled propellant tank. Finally, frequent assembly and disassembly at the threaded connections between among the tanks, regulators and gun-mounted receptacles causes damaging Paintball guns include pneumatic designs where compressed gas is being used to power those guns and expell paintball. The gas from the gas tank is received at relatively high pressure to the regulator which delivers gas to the paintball gun at reduced more consistent pressure. The most popular mounting method of the regulator to the gun is an ASA threaded connection, where the regulator includes a male threaded end with sealing rings and a check valve with a valve pin ready to be pushed to open gas flow, and a the female threaded receptacle mounted on the paintball gun with sealing land to provide sealed connection with the regulator. The extending pin located inside the ASA receptacle pushes the check valve pin to the open position during the mounting process. The sequence of events while connecting regulator to the gun is such: the regulator is screwed into the gun's adapter, and then during this process a sealed connecting is created between the regulator and the gun input receptacle, the extending pin located inside the adapter will start pushing on the check valve pin and subsequently open compressed gas flow from the pressure regulator to the gun.

A disadvantage of this type connection is that opening for the gas flow is provided before the regulator is fully secured and received into the adapter. This early opening can be a problem when a charged tank is being connected to a gun. As soon as slight channel for gas flow is provided, gas exerts pressure and therefore creates resistance between the components. More specifically, opposing forces are exerted on the face of the regulator and on internal surface of the adapter. In case of tank gas pressure of 850 psi, the force on a given component can be as much as 320 lbs. After the small gas flow channel is first created, additional turns are needed for the check valve to be fully open and therefore provide a proper full-flow channel to power the paintball gun. Those few additional turns under pressure have an especially adverse effect on the micro-finish of the thread surface. Frequent mounting and unmounting cycles lead to a distortion of the threads to the point of a friction welding phenomenon, especially when both connecting parts are made of aluminum. Utilization of aluminum as a choice of material is due to a light weight which is an important factor for a paintball players.

The above described friction welding problem can contribute to safety risks during disassembly of the main parts of the regulator (see FIG. 1). since the regulator piston housing becomes friction welded to the adapter at the thread connection, the two main parts of the regulator (i.e., piston housing and main body) are more likely to be inadvertently disassembled when the user continues forcing the process of unscrewing.

What is needed is a paintball gun system which provides a safer, faster and/or more reliable interconnection among the tank, regulator and gun receptacle/input components.

BRIEF SUMMARY OF THE INVENTION

The present invention is embodied in a paintball gun system comprising a gun body and a propellant tank interconnected by a quick-change coupling. The quick-change coupling partially defines a fluid pathway between the tank and the gun body in that it is included in a sequence of components from the tank to a pneumatic circuit in the paintball gun body. The quick-change coupling includes a gun-side fitting and a tank-side fitting. The gun-side fitting is in communication with the gun body at one end and terminates in an opposite open-end configured for sealed engagement of the tank-side fitting. The tank-side fitting being is in communication with the tank and has an opposite open end for sealed engagement of the gun-side fitting. Each fitting has complementary interlocking contours.

When the gun side fitting and the tank side fitting are coupled, tangs located on the tank side fitting prevent accidental disassembly. The sequence for interconnecting both fittings of the quick coupling is such: first, dogs located in the tank side fitting are aligned angularly with the notches formed in the gun side fitting, than the tank side fitting is pushed into and rotated until the stop is hit and dogs pass the tangs. The final stage of assembly is reached when the spring or pressure from the gas tank biases both fittings away from each other.

In one embodiments the paintball gun system includes a pressure regulator operably connected between the tank and the gun body and the tank-side fitting is implemented as a portion of the regulator.

In an alternate embodiment, the paintball gun system includes a pressure regulator operably connected between the tank and the gun body. In this embodiment, the regulator has opposing threaded portions and the quick change assembly is implemented as adapter insert between the regulator and the paintball gun body. More specifically, the gun-side fitting and the tank-side fitting are opposing portions of the adapter insert each fitting has a threaded portion and an opposing quick change portion.

In another embodiment, the regulator is omitted as in CO2 type gun system. Such paintball gun systems include an adapter insert operably connected between the tank and the gun body. The gun-side fitting and the tank-side fitting are opposing portions of the adapter insert.

BRIEF DESCRIPTION OF THE DRAWINGS

In the accompanying drawings that form part of the specification.

DETAILED DESCRIPTION OF THE INVENTION

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

This invention relates to a gas pressure regulator or CO2 tank and more particularly to a gas pressure regulator or CO2 tank that employs a user friendly quick disconnect coupling system. An objective of the present invention herein is to provide a paintball gun system with a safer method of interconnecting pressure regulator or CO2 tank with paintball gun.

Figure 1:
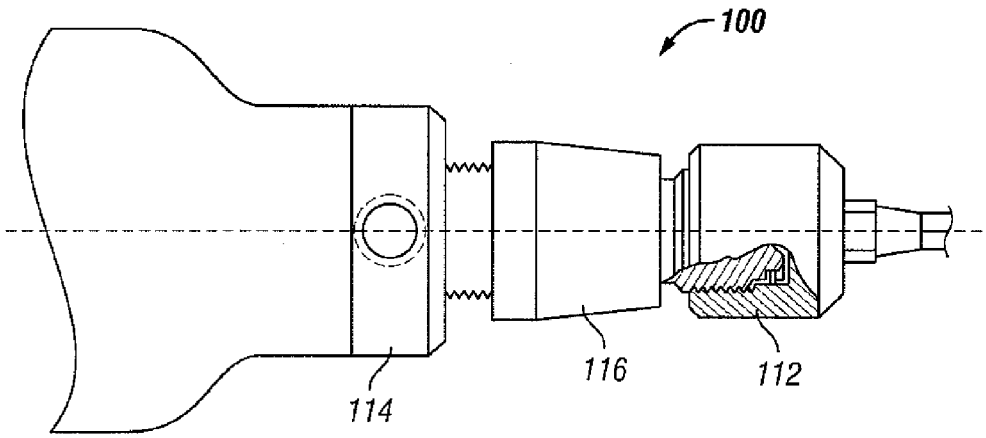
FIG. 1 is a side elevation view, partly in section, of a regulator, pressure tank and the paintball gun grip connection portion of a prior art gun system 100 illustrating a damaged (friction welded) thread 112 on the regulator adapter connection in partial cross section which resulted in disassembly of the main parts (114 and 116) of the regulator.
Figures 2, 3:
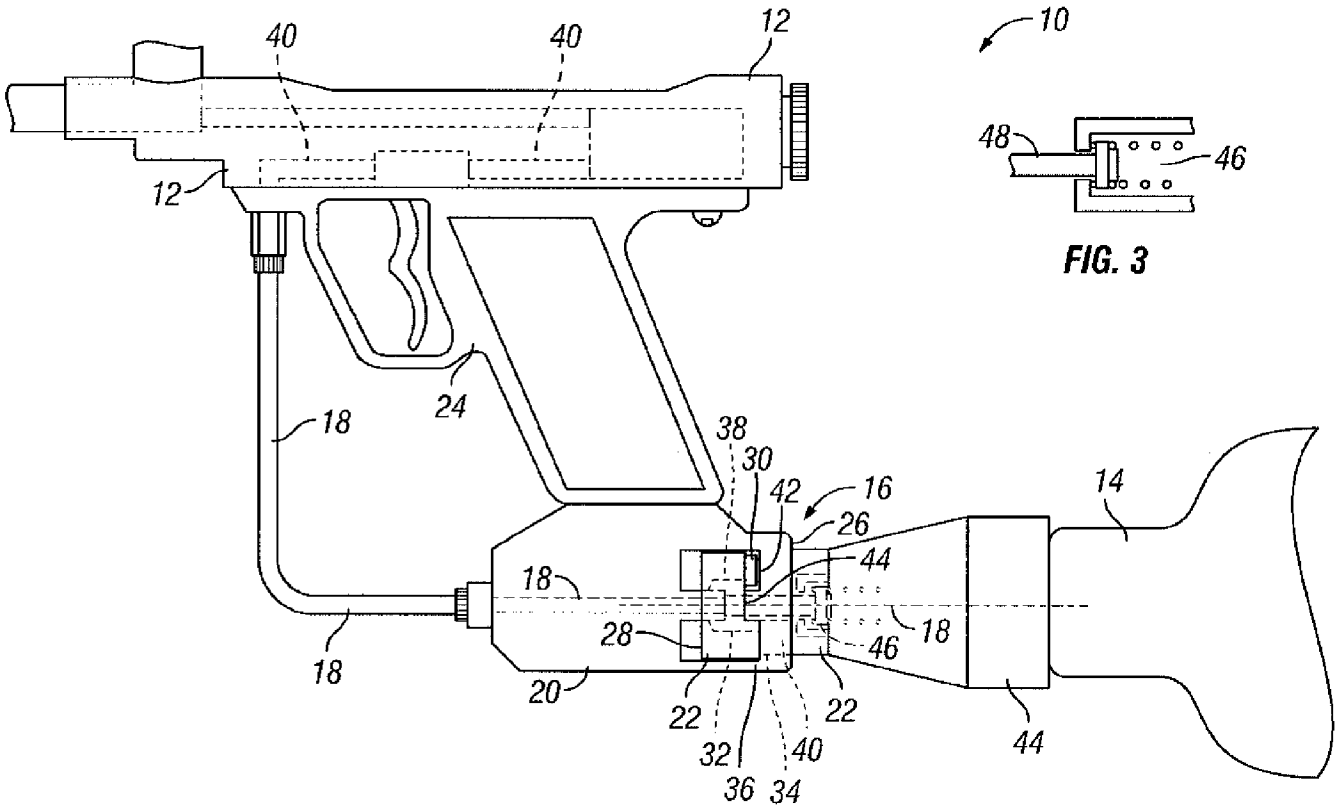
FIG. 2 is side elevation view of a paintball gun system according to the present invention including a regulator interconnected between the gun body and the tank.
FIG. 3 is an enlarged section view of the check valve portion of the fluid pathway of FIG. 2 shown in a closed position.

Referring to FIG. 2, a paintball gun system 10 is shown with a gun body 12, a propellant tank 14, and a quick change coupling 16. Gun body 12 and propellant tank 14 are interconnected by a quick-change coupling 16 that partially defines a fluid pathway 18 from tank 14 to gun body 12. Quick-change coupling 16 includes a gun-side fitting 20 and a tank-side fitting 22. Gun-side fitting 20 is mounted to gun body 12 at grip 24 and terminates in an open-end 26 configured for sealed engagement of tank-side fitting 28. Tank-side fitting 22 is in communication with tank 14 and has an opposite open end 28 for sealed engagement of gun-side fitting 20.

As used herein, the term fitting is a reference to a separate part, collection of parts or an open portion of another component which is configured for mechanically, removably interconnecting and defining a confined flow passageway between fittings when connected.

Each fitting 20 and 22 of coupling 16 has complementary interlocking contours. The complementary interlocking contours preferably take the form of one or more dogs 30 on a nipple portion 32 of tank-side fitting 22 and notches 34 on a cap portion 36 of gun-side fitting 20 configured to receive dogs 30. Gun-side fitting 20 has an inlet port 38 in communication with fluid pathway 18 and therefore pneumatic circuit 40 of gun body 12. The contour of notches 34 preferably includes an entry portion 40, a rotation portion (not separately identified) and a locking-portion 42. The locking portion includes stops 44 on opposite sides of dogs 30.

In an alternate embodiment, dogs 30 are tapered and the contour of notches 34 is relatively linear such that gun-side fitting 20 and tank-side fitting 22 are drawn together in response to counter-rotation (i.e., rotating one fitting respect to the other or counter-rotating both fittings).

Tanks-side fitting 22 is present on a distal end portion of a regulator 44. A check valve 46 is operably disposed within fluid pathway 18. More specifically check valve 46 is provided in regulator 44 to block release of compressed gas from tank 14 when the tank 14-regulator-44 subassembly is disconnected from gun side fitting 20. Check valve 46 is spring biased towards gun side fitting 20 such that a valve pin 48 is offset into an open position when the coupling 16 is engaged. FIG. 3 is an enlarged, schematic cross section of valve 42 in a closed position.

Figure 4:
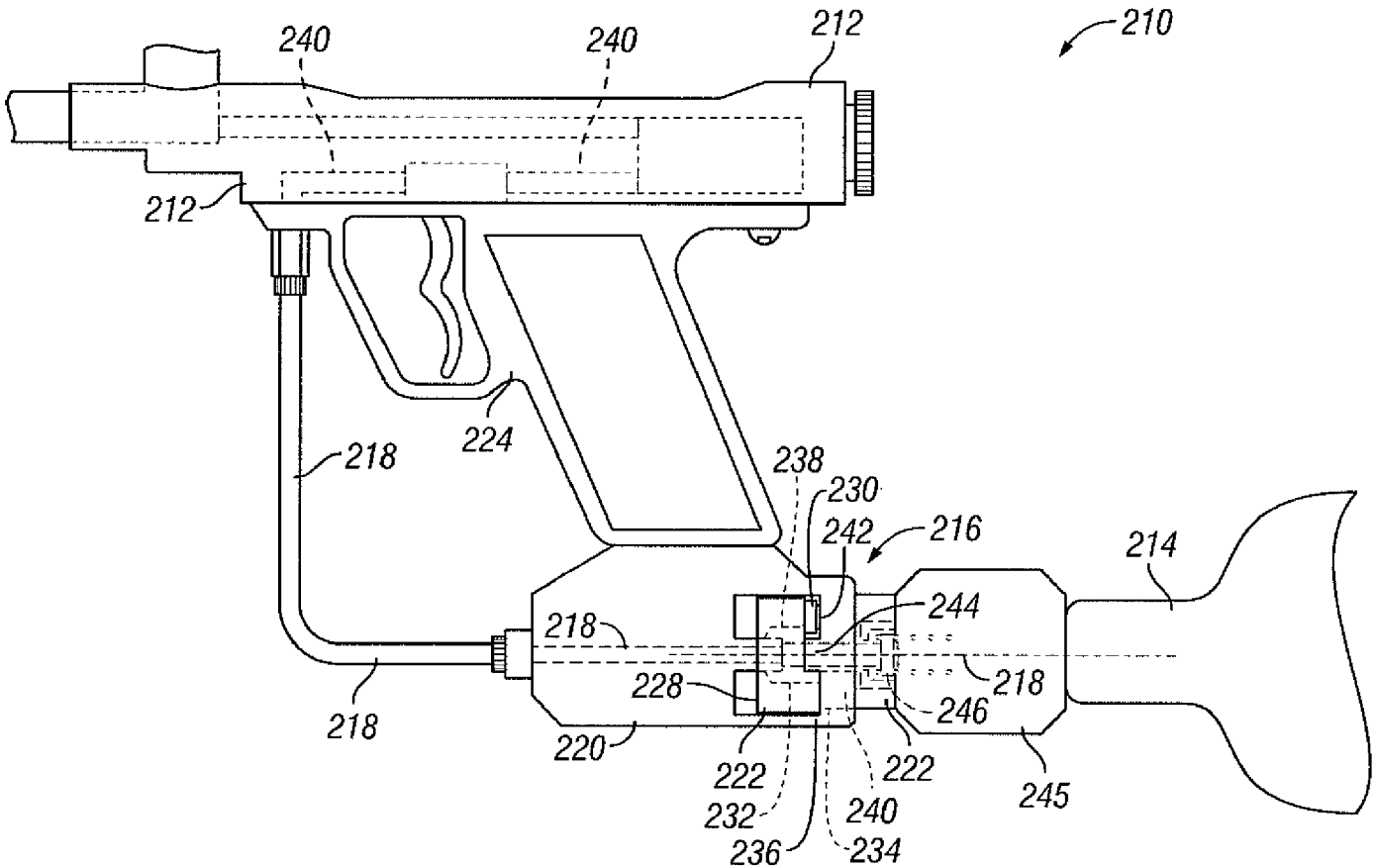
FIG. 4 is a side elevation view of an alternate embodiment of the present invention in which a check valve assembly is interconnected between the tank and the gun body but a regulator is not required (such as a CO2 system)

FIG. 4 is an alternate embodiment of the present invention for a gun system in which a regulator is not required at the tank outlet. Paintball gun system 210 includes a gun body 212, a propellant tank 214, and a quick change coupling 216. Gun body 212 and propellant tank 214 are interconnected by a quick-change coupling 216 that partially defines a fluid pathway 218 from tank 214 to gun body 212. Quick-change coupling 216 includes a gun-side fitting 220 and a tank-side fitting 222. Gun-side fitting 220 is mounted to gun body 212 at grip 224 and terminates in an open-end 226 configured for sealed engagement of tank-side fitting 228. Tank-side fitting 222 is in communication with tank 214 and has an opposite open end 228 for sealed engagement of gun-side fitting 220.

Each fitting 220 and 222 of coupling 16 has complementary interlocking contours. The complementary interlocking contours preferably take the form of one or more dogs 230 on a nipple portion 232 of tank-side fitting 222 and notches 234 on a cap portion 236 of gun-side fitting 220 configured to receive dogs 230. Gun-side fitting 220 has an inlet port 238 in communication with fluid pathway 218 and therefore pneumatic circuit 240 of gun body 212. The contour of notches 234 preferably includes an entry portion 240, a rotation portion (not separately identified) and a locking-portion 242. The locking portion includes stops 244 on opposite sides of dogs 230.

Tanks-side fitting 222 is present on a distal end portion of a check valve component 245. A check valve 246 is operably disposed within fluid pathway 218. More specifically, check valve 246 is provided in a separate component 245 to block release of compressed gas from tank 214 when the tank 214-check valve component-245 subassembly is disconnected from gun side fitting 220. Check valve 246 is spring biased towards gun side fitting 220 such that a valve pin 248 is offset into an open position when the coupling 216 is engaged.

Figures 5, 6:
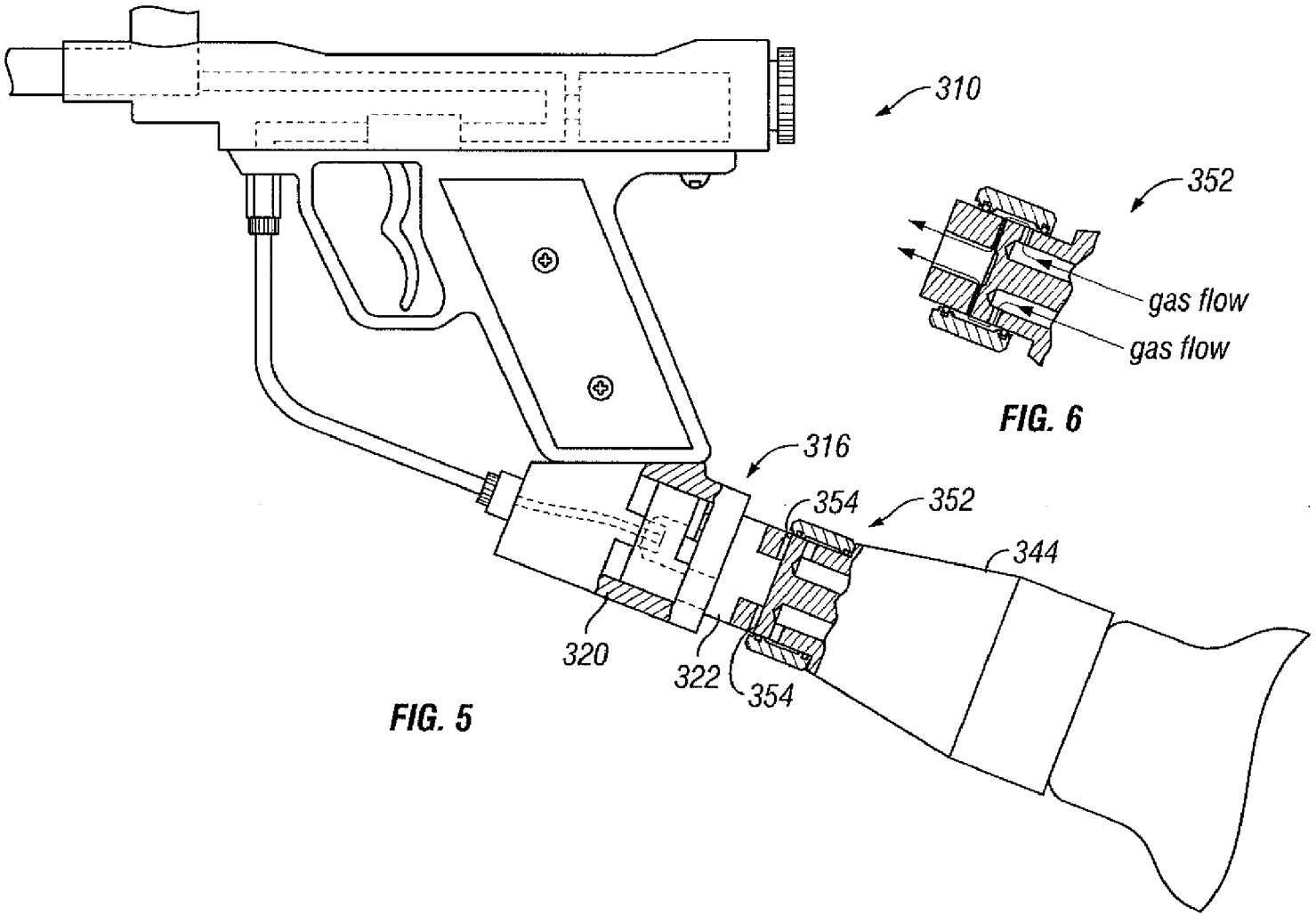
FIG. 5 is a side elevation view, partly in section, of a gun system according to the present invention in which an on-off subassembly is provided as a part of the regulator shown in the flow-off position.
FIG. 6 is an enlarged cross-section view of the on-off subassembly shown in the flow-on position.

The alternate embodiment shown in FIG. 5, gun system 310, includes a sliding on-off mechanism 352 between tank 314 and quick-change coupling 316. More specifically, on-off mechanism 352 is provided on regulator 344 together with a distal tank-side fitting 322. On-off mechanism 352 includes venting via radial channels 354. Further details of the sliding on-off mechanism are provided in U.S. Provisional Application No. 60/737,468 to Gabrel, filed the specification and drawings of which are expressly incorporated herein by reference. An advantage of gun system 310 is that gas pressure can be substantially relieved from coupling 316 during connection and separation because gas flow from tank 344 is blocked and gas from the gun-side is vented when mechanism 352 is in the off position. FIG. 5 shows mechanism 352 in the off position and FIG. 6 is an enlarged cross section of mechanism 352 in the open or on position.

Figure 7:
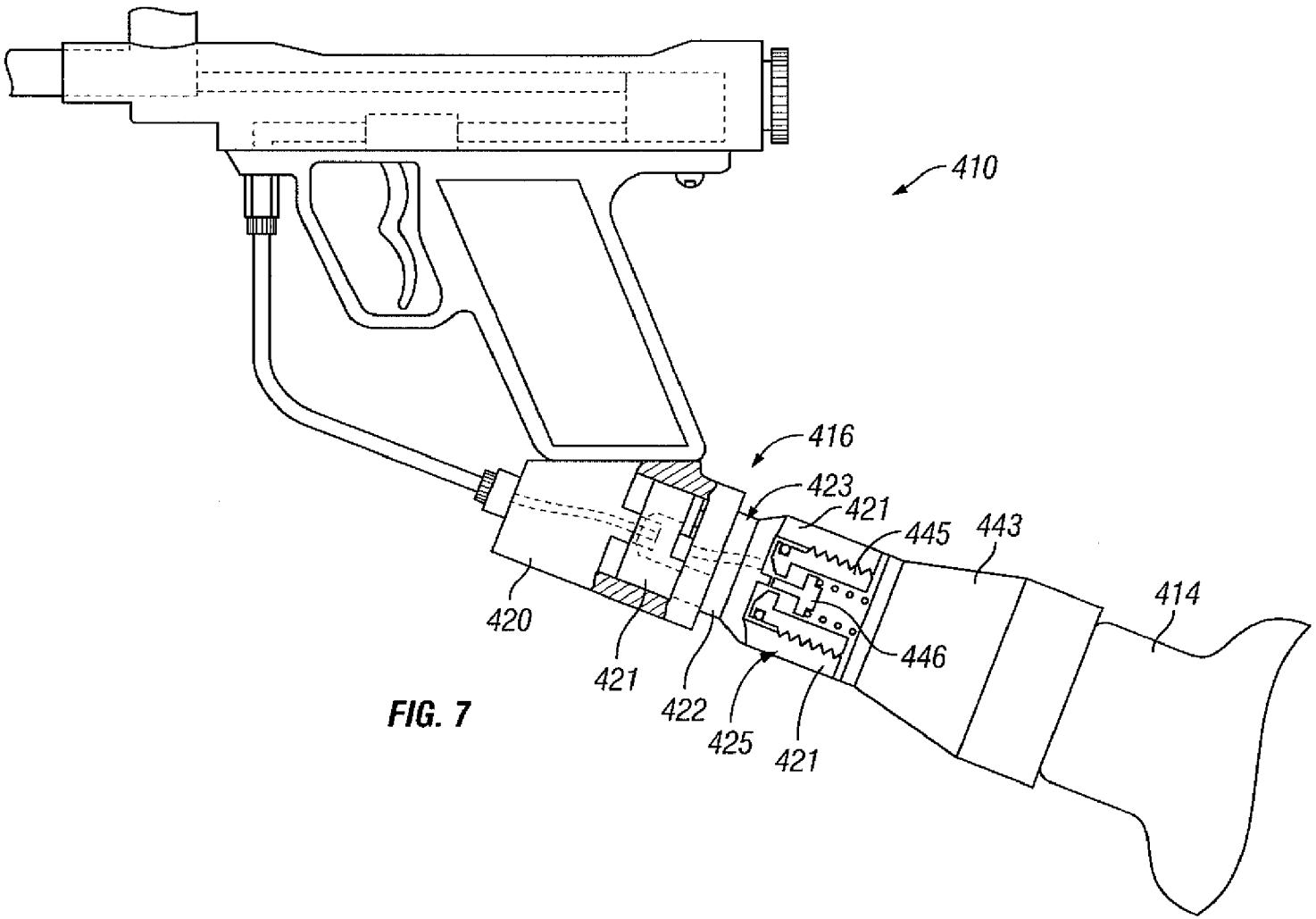
FIG. 7 is a side elevation view, partly in section, of a gun system according to the present invention in which the tank-side fitting of the quick-change coupling is an insert equipped with an internal check-valve (not separately shown)

In the alternate embodiment shown in FIG. 7, gun system 410, the tank-side fitting 422 of quick coupling 416 takes the form of an insert 421 with a quick coupling fitting portion 423 and a threaded portion 425. Gun system 410 has the advantage of allowing for the use of a regulator 443 which has conventional connections such as an ASA threaded cap portion 445 with a check valve 446. Accordingly, one may create a gun system of the present invention by selectively modifying a more conventional gun system. A possible disadvantage of this approach is that insert 421 adds to the overall length of the gun system.

Figure 8:
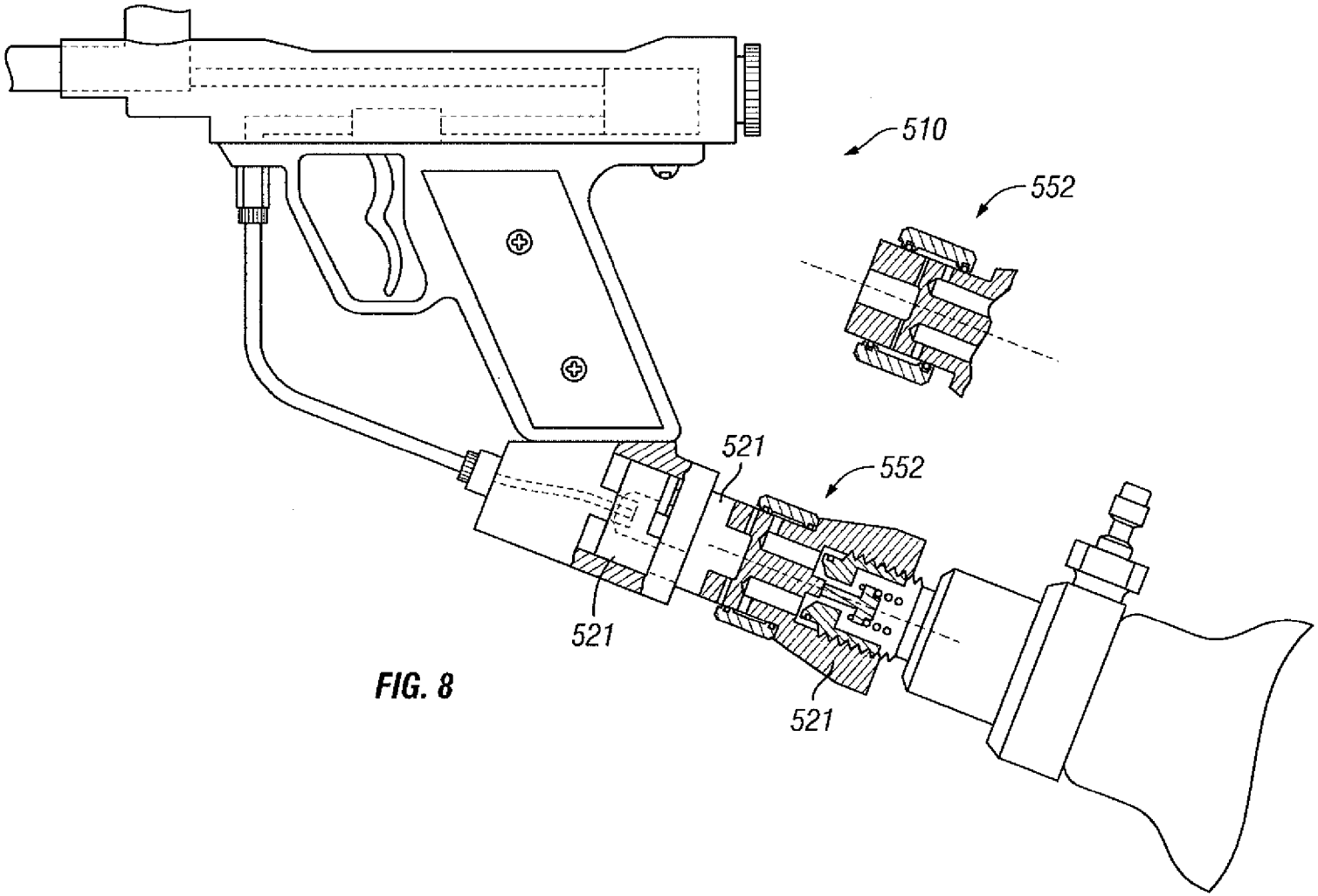
FIG. 8 is a side elevation view, partly in section, of a gun system according to the present invention in which the tank-side fitting of the quick-change coupling is an insert equipped with an on-off valve.

The alternate embodiment shown in FIG. 8, gun system 510, adds a sliding on-off mechanism 552 to a quick-coupling insert 521. Insert 521 has details and a purpose as described in reference to insert 421 in FIG. 7. On-off mechanism 552 has details and a purpose as described in reference to on-off mechanism 352 in FIGS. 5 and 6. Gun system 510 has the dual advantages of allowing for connection and separation without gas pressure, and the existing components with conventional ASA threaded connections.

Figure 9:
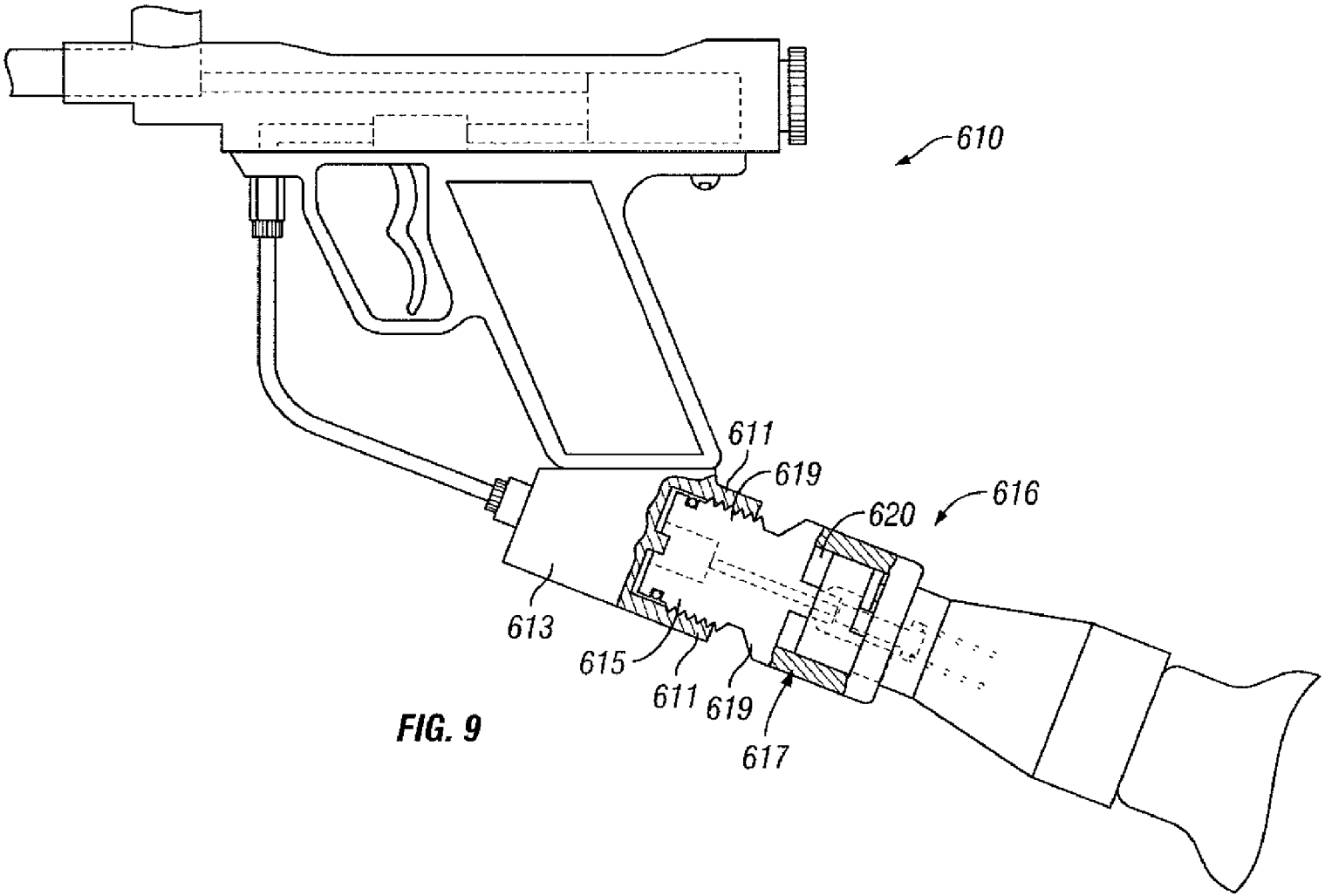
FIG. 9 is a side elevation view, partly in section, of a gun system according to the present invention in which the gun-side fitting of the quick-change coupling is an insert.

In the alternate embodiment shown in FIG. 9, gun system 610, the gun-side fitting 620 of quick coupling 616 takes the form of an insert 619 with a quick coupling fitting portion 617 and a threaded portion 615. Gun system 610 has the advantage of allowing for the use of a gun-mounted receptacle 613 which has conventional connections such as an ASA threaded receptacle 611. Accordingly, one may create a gun system of the present invention by selectively modifying a more conventional gun system. A possible disadvantage of this approach is that insert 619 adds to the overall length of the gun system.

Figure 10:
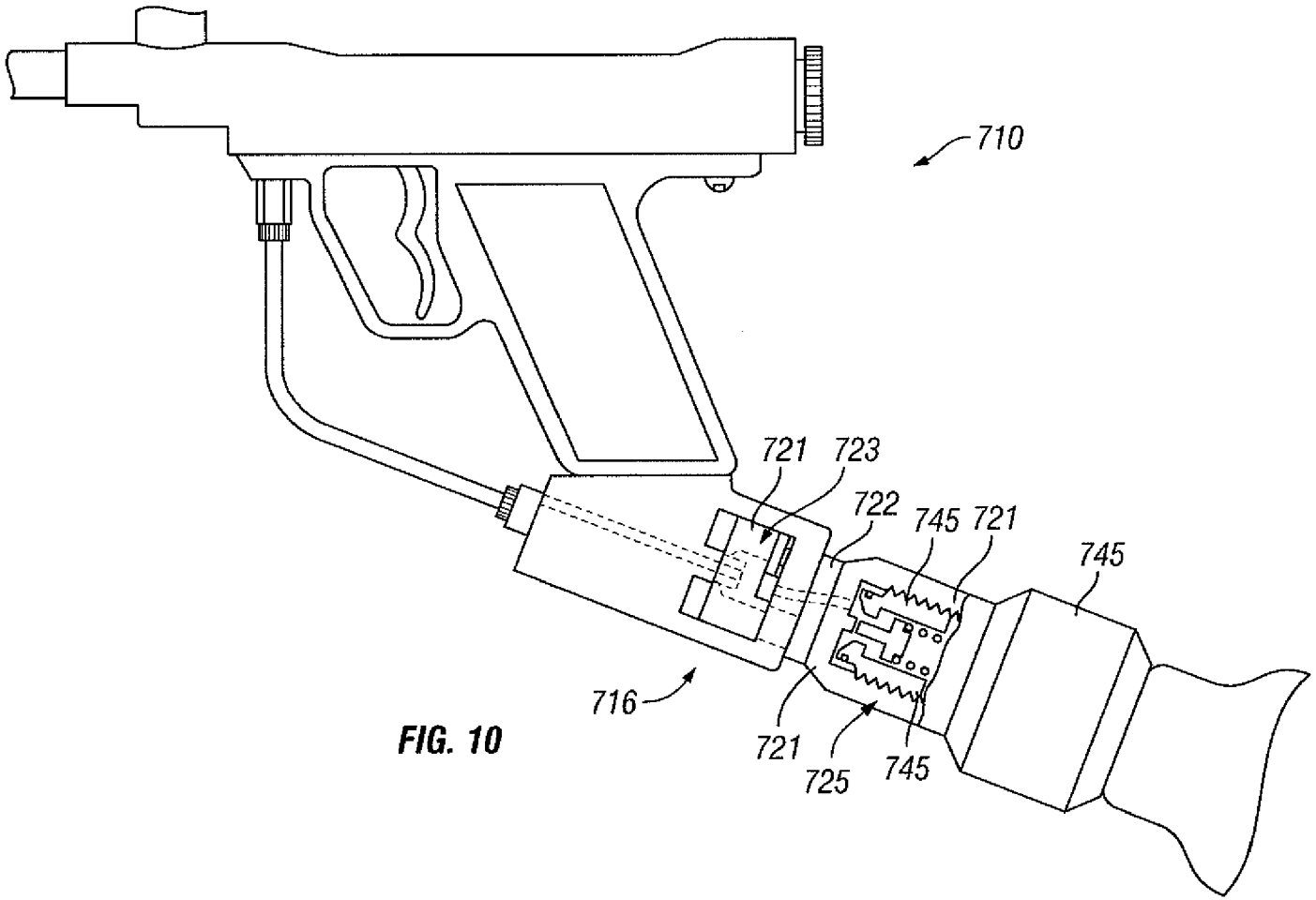
FIG. 10 is a side elevation view, partly in section, of a gun system according to the present invention in which the tank-side fitting of the quick-change coupling is an insert equipped with an internal check-valve (not separately shown).

In the alternate embodiment shown in FIG. 10, gun system 710, the tank-side fitting 722 of quick coupling 716 takes the form of an insert 721 with a quick coupling fitting portion 723 and a threaded portion 725. Gun system 710 is comparably to gun system 410 (FIG. 7) except that gun system 710 is shown without a regulator in the fluid pathway. Gun system 710 instead has a check valve component 745, an arrangement that is commonly associated with CO2 powered gun system.

Numerous variations and modifications of the embodiments described above can be effected without departing from the spirit and scope of the novel features of the invention. It is to be understood that no limitation with respect to the specific apparatus illustrated herein is intended or should be inferred. It is, of course, intended to cover by the appended claims, all such modifications as fall within the scope of the claims.

What is claimed is:

1. A paintball gun system comprising:

a gun body associated with a gun-side fitting for receiving a source of propellant gas;

a propellant tank including a source of propellant gas;

a regulator associated with the propellant tank for controlling the flow of propellant gas out of the propellant tank;

an insert including a first end and a second end, wherein the first end is configured for sealed engagement with the gun-side fitting and the second end is configured for sealed engagement with the regulator, wherein the insert defines a first passageway in fluid communication with the regulator and a second passageway in fluid communication with the gun-side fitting;

an on-off mechanism movable between a first position and a second position, wherein the on-off mechanism provides fluid communication between the first passageway and second passageway when in the first position, but does not allow fluid communication between the first passageway and the second passageway in the second position.

2. The paintball gun system of claim 1, wherein the first end of the insert comprises a quick coupling fitting portion.

3. The painthall gun system of claim 2, wherein the second end of the insert comprises a threaded portion configured to be received by the regulator.

4. The painthall gun system of claim 3, wherein the threaded portion includes internal threads defined in the insert that mate with external threads on the regulator.

5. The painthall gun system of claim 4, wherein the gun-side fitting is coupled with a grip portion of the gun body.

6. The painthall gun system of claim 1, wherein the second passageway is vented to the atmosphere when the on-off mechanism is in the second position.

7. The paintball gun system of claim 1, wherein the first passageway includes a radially extending portion that terminates with a vent port disposed on an exterior surface of the insert.

8. The paintball gun system of claim 7, wherein the vent port is configured to vent propellant gas from the insert in a radial manner.

9. The paintball gun system of claim 1, wherein the second passageway includes a radially extending portion that terminates with a vent port disposed on an exterior surface of the insert.

10. The paintball gun system of claim 1, wherein the regulator includes a valve arrangement that is movable between an open position that allows flow of propellant gas out of the propellant tank and a closed position that blocks flow of propellant gas, and wherein the insert includes a pin that is configured to move the valve arrangement to the open position when the insert engages the regulator.

11. A paintball gun system comprising:

a gun body associated with a gun-side fitting for receiving a source of propellant gas, wherein the gun-side fitting is coupled with a grip portion of the gun body;

a propellant tank including a source of propellant gas;

a regulator associated with the propellant tank for controlling the flow of propellant gas out of the propellant tank;

an insert including a first end comprising a quick coupling fitting portion for sealed engagement with the gun-side fitting and a second end comprising a threaded portion configured to be received by the regulator, wherein the insert defines a first passageway in fluid communication with the regulator and a second passageway in fluid communication with the gun-side fitting;

an on-off mechanism movable between a first position and a second position, wherein the on-off mechanism provides fluid communication between the first passageway and second passageway when in the first position, but does not allow fluid communication between the first passageway and the second passageway in the second position; and wherein the second passageway is vented to the atmosphere when the on-off mechanism is in the second position.

12. The paintball gun system of claim 11, wherein the threaded portion includes internal threads defined in the insert that mate with external threads on the regulator.

13. The paintball gun system of claim 11, wherein the on-off mechanism surrounds at least a portion of the insert.

14. The paintball gun system of claim 13, wherein the on-off mechanism has an approximately circular cross-section.

15. The paintball gun system of claim 11, wherein the first passageway includes a radially extending portion that terminates with a vent pod disposed on an exterior surface of the insert.

16. The paintball gun system of claim 15, wherein the second passageway includes a radially extending portion that terminates with a vent pod disposed on an exterior surface of the insert.

17. The paintball gun system of claim 11, wherein the regulator includes a valve arrangement that is movable between an open position that allows flow of propellant gas out of the propellant tank and a closed position that blocks flow of propellant gas, and wherein the insert includes a pin that is configured to move the valve arrangement to the open position when the insert engages the regulator.

18. A paintball gun system comprising:

a gun body associated with a gun-side fitting for receiving a source of propellant gas, wherein the gun-side fitting is coupled with a grip portion of the gun body;

a propellant tank including a source of propellant gas;

a regulator associated with the propellant tank for controlling the flow of propellant gas out of the propellant tank;

an insert including a first end configured to provide sealed engagement with the gun-side fitting and a second end configured to provide sealed engagement with the regulator, wherein the insert defines a first passageway in fluid communication with the regulator and a second passageway in fluid communication with the gun-side fitting;

an on-off mechanism movable along a longitudinal axis of the insert between a first position and a second position, wherein the on-off mechanism includes a third passageway that provides fluid communication between the first passageway and second passageway when the on-off mechanism is in the first position, but does not allow fluid communication between the first passageway and the second passageway in the second position; and wherein the on-off mechanism surrounds at least a portion of the insert.

19. The paintball gun system of claim 18, wherein the on-off mechanism has an approximately circular cross-section.

20. The paintball gun system of claim 18, wherein the first passageway includes a radially extending portion that terminates with a vent port disposed on an exterior surface of the insert.

21. The paintball gun system of claim 20, wherein the second passageway includes a radially extending portion that terminates with a vent port disposed on an exterior surface of the insert.

22. The paintball gun system of claim 18, wherein the regulator includes a valve arrangement that is movable between an open position that allows flow of propellant gas out of the propellant tank and a closed position that blocks flow of propellant gas, and wherein the insert includes a pin that is configured to move the valve arrangement to the open position when the insert engages the regulator.

* * * * *